US011415034B2

(12) United States Patent
Montgomery

(10) Patent No.: US 11,415,034 B2
(45) Date of Patent: Aug. 16, 2022

(54) AFTERTREATMENT SYSTEM AND METHOD OF TREATING EXHAUST GASES

(71) Applicant: Caterpillar Inc., Peoria, IL (US)

(72) Inventor: David Todd Montgomery, Edelstein, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/101,745

(22) Filed: Nov. 23, 2020

(65) Prior Publication Data

US 2022/0162971 A1 May 26, 2022

(51) Int. Cl.
*F01N 3/20* (2006.01)
*F01N 3/08* (2006.01)
*F01N 3/10* (2006.01)

(52) U.S. Cl.
CPC ..... *F01N 3/208* (2013.01); *F01N 3/0842* (2013.01); *F01N 3/106* (2013.01); *F01N 2610/02* (2013.01); *F01N 2610/1453* (2013.01); *F01N 2900/1402* (2013.01)

(58) Field of Classification Search
CPC combination set(s) only.
See application file for complete search history.

(56) References Cited

U.S. PATENT DOCUMENTS 7,998,423 B2 8/2011 Boorse et al.
8,889,587 B2 11/2014 Lewis et al.
9,011,809 B2 4/2015 Ito et al.
9,132,386 B2 * 9/2015 Udd ..... F01N 3/035
9,528,413 B2 * 12/2016 Katare ..... F01N 3/10
9,993,772 B2 6/2018 Gilbert et al.
10,690,033 B1 * 6/2020 Johnson ..... F01N 3/106
10,906,031 B2 * 2/2021 Goffe ..... B01J 29/783
11,008,917 B2 * 5/2021 Adelman ..... F01N 13/009
2003/0209011 A1 * 11/2003 Duvinage ..... F01N 13/009 60/286
2008/0131345 A1 6/2008 Vitse et al.
2011/0011068 A1 * 1/2011 Ren ..... B01J 29/46 60/297
2019/0383186 A1 * 12/2019 Dou ..... F01N 3/021

* cited by examiner

*Primary Examiner* — Binh Q Tran
(74) *Attorney, Agent, or Firm* — Brannon Sowers & Cracraft

(57) ABSTRACT

An aftertreatment system for treatment of exhaust gases exiting an engine includes a first Selective Catalytic Reduction (SCR) device in fluid communication with the engine. The first SCR device receives the exhaust gases exiting the engine for reducing a first quantity of oxides of nitrogen (NOx) present in the exhaust gases. The aftertreatment system also includes an oxidation catalyst in fluid communication with the first SCR device. The oxidation catalyst receives the exhaust gases exiting the first SCR device for oxidizing ammonia present in the exhaust gases into a second quantity of NOx. The aftertreatment system further includes a second SCR device in fluid communication with the oxidation catalyst. The second SCR device receives the exhaust gases exiting the oxidation catalyst for reducing the second quantity of NOx.

20 Claims, 3 Drawing Sheets

AFTERTREATMENT SYSTEM AND METHOD OF TREATING EXHAUST GASES

TECHNICAL FIELD

The present disclosure relates to aftertreatment systems. More particularly, the present disclosure relates to an engine system having an engine and an aftertreatment system, and a method of treating exhaust gases exiting the engine.

BACKGROUND

In order to comply with emission regulation standards, an engine system includes an aftertreatment system for reducing and converting oxides of nitrogen (NOx) that may be present in exhaust gases. The aftertreatment system treats and reduces NOx present in the exhaust gases, prior to the exhaust gases exiting into atmosphere.

Further, exhaust gases exiting engines that combust ammonia as a primary fuel include a higher concentration of NOx and ammonia. Aftertreatment systems that are currently being investigated in the industry for treating exhaust gases exiting such ammonia fueled engines typically include a two-bed system. The two-bed system includes an oxidation catalyst and a selective catalytic reduction (SCR) device. The oxidation catalyst oxidizes the ammonia into NOx. Further, the exhaust gases exiting the oxidation catalyst include higher concentration of NOx with minimal or no ammonia concentration. The exhaust gases then pass through the SCR device that reduces the NOx in the exhaust gases to diatomic nitrogen ($N_2$) and water ($H_2O$).

Before the exhaust gases enter the SCR device, a reductant is typically dosed into the exhaust gases passing through the aftertreatment system. In ammonia fueled engines, such a two-bed system requires a larger SCR device and a higher amount of reductant to be dosed in the exhaust gases before the exhaust gases pass through the SCR device due to the NOx produced in the oxidation catalyst. An increase in the amount of reductant may in turn increase an overall operating cost of the aftertreatment system, which is not desirable.

U.S. Pat. No. 8,889,587 describes a catalyst system including a first catalytic composition including a first catalytic material disposed on a metal inorganic support. The metal inorganic support has pores and at least one promoting metal. The catalyst system also includes a second catalytic composition comprising a zeolite, or a first catalytic material disposed on a first substrate, the first catalytic material comprising an element selected from the group consisting of tungsten, titanium, and vanadium. The catalyst system further includes a third catalytic composition. The catalyst system includes a delivery system configured to deliver a reductant and optionally a co-reductant. A catalyst system comprising a first catalytic composition, the second catalytic composition, and the third catalytic composition is also provided.

SUMMARY OF THE DISCLOSURE

In an aspect of the present disclosure, an aftertreatment system for treatment of exhaust gases exiting an engine is provided. The aftertreatment system includes a first Selective Catalytic Reduction (SCR) device in fluid communication with the engine and positioned downstream of the engine in an exhaust gas flow path. The first SCR device receives the exhaust gases exiting the engine for reducing a first quantity of oxides of nitrogen (NOx) present in the exhaust gases. The aftertreatment system also includes an oxidation catalyst in fluid communication with the first SCR device and positioned downstream of the first SCR device in the exhaust gas flow path. The oxidation catalyst receives the exhaust gases exiting the first SCR device for oxidizing ammonia present in the exhaust gases into a second quantity of NOx. The aftertreatment system further includes a second SCR device in fluid communication with the oxidation catalyst and positioned downstream of the oxidation catalyst in the exhaust gas flow path. The second SCR device receives the exhaust gases exiting the oxidation catalyst for reducing the second quantity of NOx.

In another aspect of the present disclosure, an engine system is provided. The engine system includes an engine that combusts ammonia as a primary fuel during an operation thereof. The engine system also includes an aftertreatment system for treatment of exhaust gases exiting the engine. The aftertreatment system includes a first SCR device in fluid communication with the engine and positioned downstream of the engine in an exhaust gas flow path. The first SCR device receives the exhaust gases exiting the engine for reducing a first quantity of NOx present in the exhaust gases. The aftertreatment system also includes an oxidation catalyst in fluid communication with the first SCR device and positioned downstream of the first SCR device in the exhaust gas flow path. The oxidation catalyst receives the exhaust gases exiting the first SCR device for oxidizing ammonia present in the exhaust gases into a second quantity of NOx. The aftertreatment system further includes a second SCR device in fluid communication with the oxidation catalyst and positioned downstream of the oxidation catalyst in the exhaust gas flow path. The second SCR device receives the exhaust gases exiting the oxidation catalyst for reducing the second quantity of NOx.

In yet another aspect of the present disclosure, a method of treating exhaust gases exiting an engine is provided. The engine combusts ammonia as a primary fuel during an operation thereof. The method includes receiving, by a first SCR device of an aftertreatment system, the exhaust gases exiting the engine for reducing a first quantity of NOx present in the exhaust gases. The first SCR device is in fluid communication with the engine and positioned downstream of the engine in an exhaust gas flow path. The method also includes receiving, by an oxidation catalyst of the aftertreatment system, the exhaust gases exiting the first SCR device for oxidizing ammonia present in the exhaust gases into a second quantity of NOx. The oxidation catalyst is in fluid communication with the first SCR device and positioned downstream of the first SCR device in the exhaust gas flow path. The method further includes receiving, by a second SCR device of the aftertreatment system, the exhaust gases exiting the oxidation catalyst for reducing the second quantity of NOx. The second SCR device is in fluid communication with the oxidation catalyst and positioned downstream of the oxidation catalyst in the exhaust gas flow path.

Other features and aspects of this disclosure will be apparent from the following description and the accompanying drawings.

DETAILED DESCRIPTION

Wherever possible, the same reference numbers will be used throughout the drawings to refer to the same or the like parts. Wherever possible, corresponding or similar reference numbers will be used throughout the drawings to refer to the same or corresponding parts.

Figure 1:
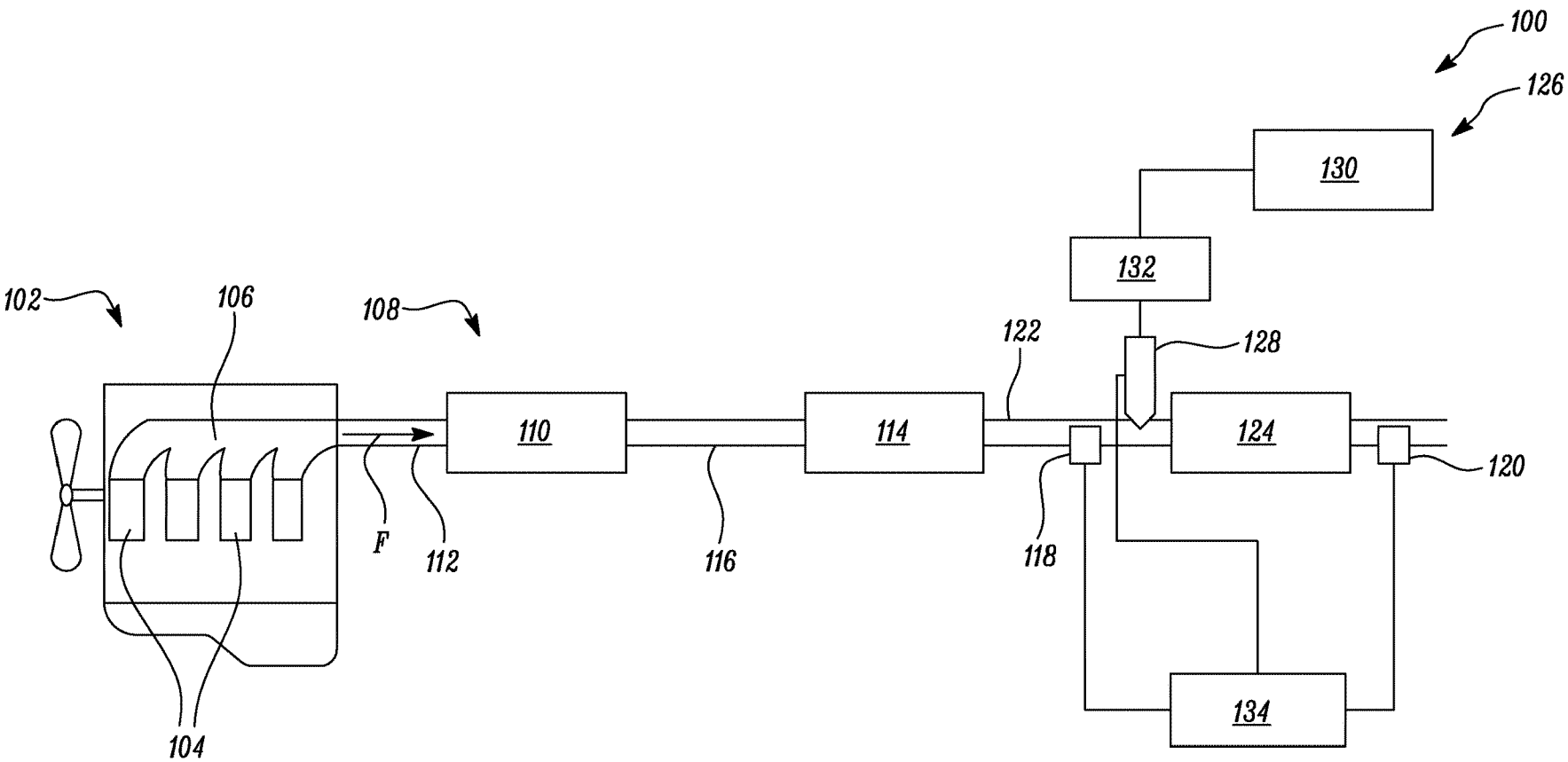
FIG. 1 is a schematic view of an engine system having an engine and an aftertreatment system, in accordance with the present disclosure.

FIG. 1 illustrates a schematic view of an engine system 100, according to an embodiment of the present disclosure. The engine system 100 may be used in a variety of machines (not shown) including, but not limited to, mobile machines such as construction machines, stationary machines such as pumps or generators, and like. The engine system 100 includes an engine 102. The engine 102 may be a combustion engine, such as a reciprocating piston engine.

Further, the engine 102 combusts ammonia as a primary fuel during an operation thereof. More particularly, the combustion of ammonia as a primary fuel produces mechanical power that is used to drive the machine in which the engine system 100 is installed. In an example, ammonia may constitute at least 80% of a total fuel requirement of the engine 102. In some examples, ammonia may constitute 90%-95%, or even as high as 100% of the total fuel requirement of the engine 102. The engine 102 may also be supplied with secondary fuels, such as diesel, petrol, and the like, during operation thereof.

The engine 102 includes a number of components (not shown) such as a crankshaft, a fuel system, an inlet manifold, an intake port, an exhaust port, and the like. Further, the engine 102 includes a number of cylinders 104 that define one or more combustion chambers. Moreover, exhaust gases generated based on combustion of ammonia are directed into an exhaust manifold 106 of the engine 102. The exhaust manifold 106 is in fluid communication with the cylinders 104. It should be noted that the exhaust gases exiting the engine 102 includes some amount of ammonia and Oxides of Nitrogen (NOx), such as Nitric Oxide (NO), Nitrous Oxide ($N_2O$), and Nitrogen Dioxide ($NO_2$), present therein.

The engine system 100 also includes an aftertreatment system 108 for treatment of exhaust gases exiting the engine 102. The aftertreatment system 108 operates to reduce/eliminate the concentration of ammonia and NOx in the exhaust gases, before the exhaust gases are let into the atmosphere. The aftertreatment system 108 is in fluid communication with the exhaust manifold 106 of the engine 102. The exhaust gases flow through the aftertreatment system 108 along an exhaust gas flow path "F". Further, the aftertreatment system 108 may include various components (not shown), such as a particulate filter for reducing a content of particulate matter in the exhaust gases, an Ammonia Slip Catalyst (ASC), and the like.

The aftertreatment system 108 includes a first Selective Catalytic Reduction (SCR) device 110 in fluid communication with the engine 102 and positioned downstream of the engine 102 in the exhaust gas flow path "F". The first SCR device 110 is in fluid communication with the exhaust manifold 106 via a first conduit 112. In some examples, one or more mixers/baffles may be disposed in the first conduit 112 for promoting mixing of the exhaust gases before the exhaust gases pass through the first SCR device 110.

The exhaust gases exiting the engine 102 include a first quantity of NOx and some amount of ammonia present therein. The first SCR device 110 receives the exhaust gases exiting the engine 102 for reducing the first quantity of NOx present in the exhaust gases. The first SCR device 110 incudes a cannister and one or more catalysts disposed within the cannister for facilitating reaction, reduction, and removal of NOx from the exhaust gases passing therethrough. The catalysts may be made up of vanadia, glass bead material, zeolite, and the like, without limiting the scope of the present disclosure. The first SCR device 110 converts NOx into diatomic nitrogen ($N_2$), and water ($H_2O$). The first SCR device 110 described herein is embodied as a "passive SCR stage" wherein reduction of NOx is facilitated without introduction of ammonia in the exhaust gases. More particularly, as the exhaust gases entering the first SCR device 110 already includes some amount of ammonia, no reductant is dosed into the exhaust gases before the exhaust gases pass through the first SCR device 110. As the exhaust gases pass through the first SCR device 110, the ammonia present in the exhaust gases reacts with the NOx to produce $N_2$ and $H_2O$ in the exhaust gases.

The aftertreatment system 108 also includes an oxidation catalyst 114 in fluid communication with the first SCR device 110 and positioned downstream of the first SCR device 110 in the exhaust gas flow path "F". As illustrated in FIG. 1, the first SCR device 110 is in fluid communication with the oxidation catalyst 114 via a second conduit 116. In some examples, one or more mixers/baffles may be disposed in the second conduit 116 for promoting mixing of the exhaust gases before the exhaust gases pass through the oxidation catalyst 114. In an example, the aftertreatment system 108 may include a sensor (not shown) disposed between the first SCR device 110 and the oxidation catalyst 114 to determine a quantity of ammonia/NOx present in the exhaust gases exiting the first SCR device 110. The sensor may be disposed in the second conduit 116. Such a sensor may be used in a feedback system for determining a performance of the first SCR device 110.

The oxidation catalyst 114 includes a cannister and one or more catalysts disposed within the cannister for facilitating oxidation of ammonia. The catalysts may be made of a monolith honeycomb substrate coated with a platinum group metal catalyst. The exhaust gases exiting the first SCR device 110 contains some amount of ammonia present therein. The oxidation catalyst 114 receives the exhaust gases exiting the first SCR device 110 for oxidizing ammonia present in the exhaust gases into a second quantity of NOx. In some examples, the oxidation catalyst 114 may oxidize NO to convert NO into $NO_2$, thereby, changing a ratio of $NO:NO_2$ within the exhaust gases. In an example, the oxidation catalyst 114 oxidizes all of the ammonia present in the exhaust gases. In other examples, the exhaust gases exiting the oxidation catalyst 114 may include traces of ammonia present therein.

The aftertreatment system 108 includes one or more sensors 118, 120 for determining an amount of NOx present in the exhaust gases. In the illustrated embodiment, the one or more sensors 118, 120 includes a first sensor 118 disposed between the oxidation catalyst 114 and a second SCR device 124 for determining the second quantity of NOx present in the exhaust gases exiting the oxidation catalyst 114. The first sensor 118 is disposed in a third conduit 122 that provides fluid communication between the oxidation catalyst 114 and the second SCR device 124. The first sensor 118 may be used in the feedback system for determining a performance of the oxidation catalyst 114.

The first sensor 118 is a NOx sensor which is typically a high-temperature device built to detect NOx concentration in the exhaust gases exiting the oxidation catalyst 114. The NOx sensor may be made up of ceramic type metal oxides.

It should be noted that the aftertreatment system 108 may include any number of sensors, without limiting the scope of the present invention.

The aftertreatment system 108 also includes a reductant dosing system 126 for dosing a reductant in the exhaust gases exiting the oxidation catalyst 114. The reductant includes ammonia or urea. It should be noted that the reductant may include any other type of fluid that is dosed into the exhaust gases, known to a person having ordinary skill in the art. In the illustrated embodiment, the reductant dosing system 126 doses ammonia in the form of an aqueous solution into the exhaust gases to reduce the NOx present in the exhaust gases.

The reductant dosing system 126 includes a reductant injector 128 to inject the reductant into the exhaust gases exiting the oxidation catalyst 114. In various examples, the reductant dosing system 126 may have a single reductant injector or multiple reductant injectors. In the illustrated example, the single reductant injector 128 is illustrated, without limiting the scope of the present disclosure. It should be noted that an amount of the reductant dosed in the exhaust gases is varied based on the amount of NOx present in the exhaust gases. In an example, the reductant injector 128 may be controlled to vary the quantity of the reductant, i.e. ammonia, that is dosed into the exhaust gases.

The reductant injector 128 is disposed downstream of the oxidation catalyst 114 and projects inside the third conduit 122. As illustrated, the reductant injector 128 is positioned between the first sensor 118 and the second SCR device 124. The reductant dosing system 126 also includes a reservoir 130. In the illustrated embodiment, the reservoir 130 is an ammonia fuel tank that contains and supplies ammonia to the engine 102. The reductant dosing system 126 further includes a pump 132 for directing the reductant towards the reductant injector 128 as and when desired.

As illustrated, the aftertreatment system 108 includes a controller 134 in communication with the one or more sensors 118, 120 and the reductant dosing system 126 for controlling the amount of the reductant being dosed in the exhaust gases. In the illustrated embodiment, the controller 134 is in communication with the first sensor 118 and the reductant injector 128 for controlling the amount of the reductant being dosed in the exhaust gases. In some examples, the controller 134 may be in communication with the pump 132. The amount of NOx in the exhaust gases that is determined by the first sensor 118 is treated as an input to the controller 134. Further, based on the input from the first sensor 118, the controller 134 controls the amount of the reductant being dosed into the exhaust gases.

The aftertreatment system 108 also includes the second SCR device 124 in fluid communication with the oxidation catalyst 114 and positioned downstream of the oxidation catalyst 114 in the exhaust gas flow path "F". The oxidation catalyst 114 and the second SCR device 124 are in fluid communication via the third conduit 122. In some examples, one or more mixers/baffles may be disposed in the third conduit 122 for promoting mixing of the exhaust gases before the exhaust gases pass through the second SCR device 124.

The second SCR device 124 incudes a cannister and one or more catalysts disposed within the cannister for facilitating reaction, reduction, and removal of NOx from the exhaust gases passing therethrough. The catalysts may be made of vanadia, glass bead material, zeolite, and the like, without limiting the scope of the present disclosure. More particularly, the second SCR device 124 receives the exhaust gases exiting the oxidation catalyst 114 for reducing the second quantity of NOx. The second SCR device 124 described herein is embodied as an "active SCR stage" wherein reduction of NOx is facilitated based on introduction of ammonia in the exhaust gases prior to the passage of the exhaust gases through the second SCR device 124. More particularly, as the exhaust gases pass through the second SCR device 124, the ammonia present in the exhaust gases reacts with the NOx in the exhaust gases to produce $N_2$ and $H_2O$ in the exhaust gases.

Further, in an example, the one or more sensors 118, 120 includes the second sensor 120 disposed downstream of the second SCR device 124 in the exhaust gas flow path "F" for determining a presence of NOx in the exhaust gases exiting the second SCR device 124. The second sensor 120 is in fluid communication with the controller 134. The second sensor 120 is a NOx sensor which is typically a high-temperature device built to detect NOx concentration in the exhaust gases exiting the second SCR device 124. The NOx sensor may be made up of ceramic type metal oxides. In an example, the quantity of NOx detected by the second sensor 120 is used by the controller 134 to precisely control the reductant to be dosed in the exhaust gases. Additionally, the second sensor 120 may be used in the feedback system for determining a performance of the second SCR device 124 or the aftertreatment system 108 itself.

Figure 2:
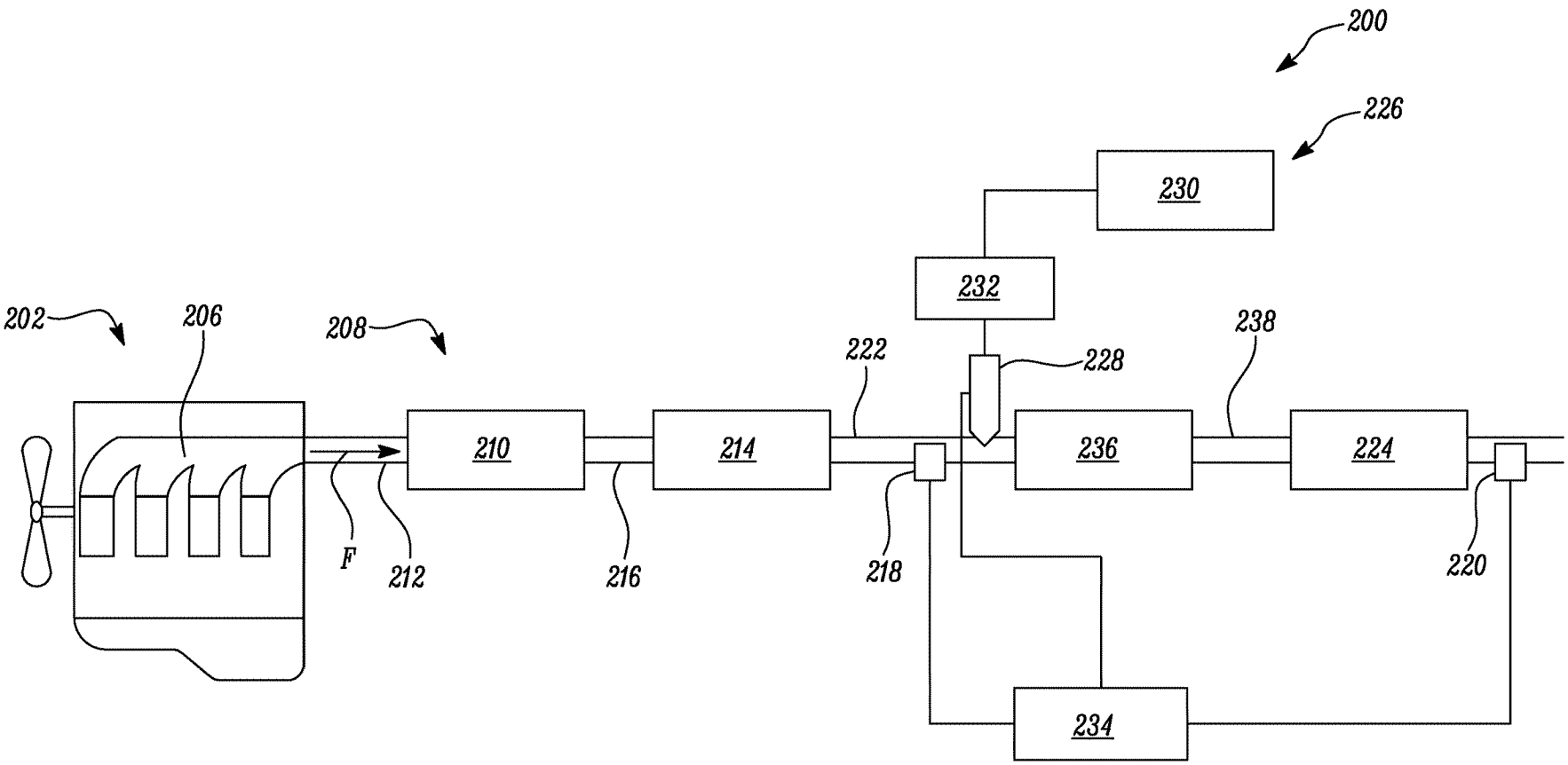
FIG. 2 is a schematic view of another engine system having an engine and an aftertreatment system, in accordance with the present disclosure.

FIG. 2 represents another embodiment of the present disclosure. More particularly, a schematic view of an engine system 200 is depicted in FIG. 2. In this embodiment, the engine system 200 includes an engine 202 which is similar to the engine 102 associated with the engine system 100 that is explained in relation to FIG. 1. The engine system 200 also includes an aftertreatment system 208 for treating the exhaust gases exiting the engine 202. The aftertreatment system 208 includes a first SCR device 210 similar to the first SCR device 110 associated with the engine system 100 that is explained in relation to FIG. 1. The first SCR device 210 is coupled to an exhaust manifold 206 of the engine 202 via a first conduit 212. The aftertreatment system 208 also includes an oxidation catalyst 214 and a second SCR device 224 similar to the oxidation catalyst 114 and the second SCR device 124 associated with the engine system 100 that is explained in relation to FIG. 1. The oxidation catalyst 214 is coupled to the first SCR device 210 via a second conduit 216.

The aftertreatment system 208 further includes a first sensor 218, a second sensor 220, and a controller 234 which is similar to the first sensor 118, the second sensor 120, and the controller 134 associated with the engine system 100 that is explained in relation to FIG. 1. The first sensor 218 is disposed at an outlet of the oxidation catalyst 214 and projects inside a third conduit 222. The aftertreatment system 208 also includes a reductant dosing system 226 for dosing reductant into the exhaust gases. In this embodiment, the reductant is urea. Generally, the urea is in the form of an aqueous solution As illustrated in FIG. 2, the reductant dosing system 226 includes a reservoir 230 that stores urea therein. Further, the reservoir 230 is in fluid communication with a reductant injector 228, via a pump 232. The reductant injector 228 and the pump 232 are similar to the similar to the reductant injector 128 and the pump 132 associated with the engine system 100 that is explained in relation to FIG. 1. Further, the aftertreatment system 208 includes a controller 234 that is similar to the controller 134 associated with the engine system 100 that is explained in relation to FIG. 1. The controller 234 controls the amount of the reductant, i.e. urea, being dosed into the exhaust gases exiting the oxidation catalyst 214 based on a second quantity of NOx present in the exhaust gases. The urea is injected into the exhaust gases that flow through the third conduit 222.

In order to facilitate NOx reduction in the second SCR device 224, hydrolysis of urea is desirable before the exhaust gases enter the second SCR device 224. The urea is dosed in the exhaust gases before the exhaust gases pass through the hydrolysis catalyst 236. In order to facilitate the hydrolysis of urea, the aftertreatment system 208 includes a hydrolysis catalyst 236 disposed between the oxidation catalyst 214 and the second SCR device 224. The hydrolysis catalyst 236 is positioned proximate the reductant injector 228. Specifically, the hydrolysis catalyst 236 is disposed between a urea dosing location and the second SCR device 224. The urea dosing location may be defined as a location where the reductant injector 228 doses the urea. Further, the hydrolysis catalyst 236 may include a metallic or ceramic substrate that is coated with a material including, but not limited to, vanadium, tungsten, and titanium dioxide. The hydrolysis catalyst 236 allows conversion of urea into ammonia. More particularly, in the hydrolysis catalyst 236, the urea is first converted into isocyanic acid and then into ammonia.

The oxidation catalyst 214 is in fluid communication with the hydrolysis catalyst 236 via the third conduit 222. In the illustrated example, the hydrolysis catalyst 236 includes a cannister and one or more catalysts disposed within the cannister. In other examples, the hydrolysis catalyst 236 and the second SCR device 224 may be disposed in the same cannister such that the hydrolysis catalyst 236 is upstream of the second SCR device 224 along an exhaust gas flow path "F". Further, the second SCR device 224 is in fluid communication with the hydrolysis catalyst 236 via a fourth conduit 238. In the second SCR device 224, the ammonia which is obtained after the hydrolysis of urea in the hydrolysis catalyst 236, reacts with the NOx in the exhaust gases to produce $N_2$ and $H_2O$, thereby reducing the concentration of ammonia and NOx.

INDUSTRIAL APPLICABILITY

The current section will be explained in relation to the engine system 100 of FIG. 1. However, it should be noted that the details provided herein are equally applicable to the engine system 200 that is described in relation to FIG. 2. The present disclosure relates to the aftertreatment system 108 that includes a three-bed catalyst system. The aftertreatment system 108 includes the first SCR device 110 that is embodied as a passive SCR device which does not require additional reductant dosage for NOx reduction. Further, the reductant is only added in the second SCR device 124 that is embodied as an active SCR device. The aftertreatment system 108 described herein utilizes smaller amounts of ammonia for NOx reduction for reducing the concentration of ammonia and NOx in the exhaust gases. Further, the reduction in the amount of the reductant being dosed may in turn reduce an operating cost and ownership of the aftertreatment system 108.

Moreover, the aftertreatment system 108 includes the first and second sensors 118, 120 and the controller 134 that allow precise control of the amount of the reductant being dosed in the exhaust gases. Specifically, the reductant dosage is based on the amount of NOx that is present in the exhaust gases. This technique may eliminate dosage of excessive amounts of the reductant and may also ensure improved performance and compliance of the aftertreatment system 108 with emission regulation standards. Further, the first and second sensors 118, 120 allow determination of NOx concentration in the exhaust gases which may in turn allow real time control of the aftertreatment system 108. Moreover, in examples wherein the reductant is ammonia, the ammonia can be easily sourced from the fuel tank associated with the engine system 100.

Figure 3:
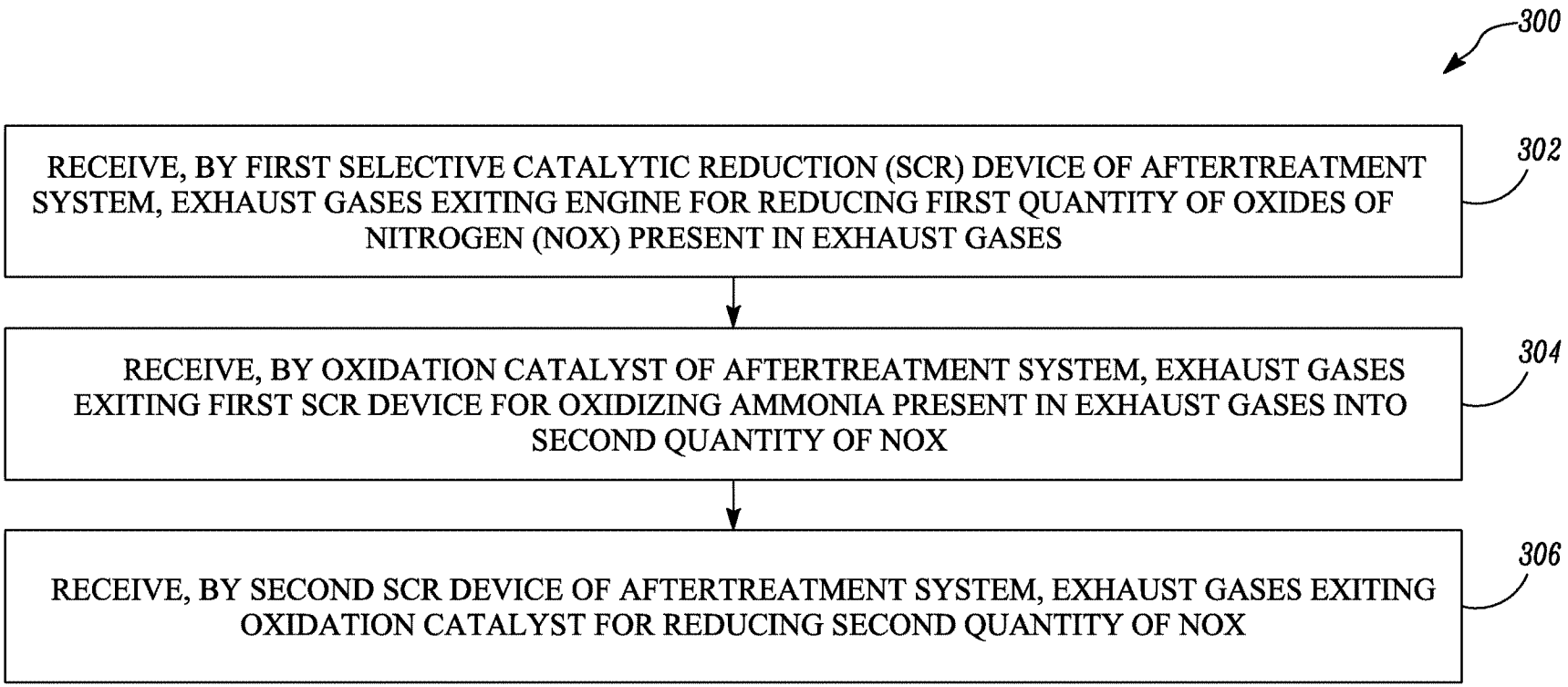
FIG. 3 is a flowchart for a method of treating exhaust gases exiting the engine.

Referring now to FIG. 3, a flowchart for a method 300 of treating the exhaust gases exiting the engine 102 is illustrated. The engine 102 combusts ammonia as the primary fuel during the operation thereof. At step 302, the first SCR device 110 of the aftertreatment system 108 receives the exhaust gases exiting the engine 102 for reducing the first quantity of NOx present in the exhaust gases. Further, the first SCR device 110 is in fluid communication with the engine 102 and positioned downstream of the engine 102 in the exhaust gas flow path "F".

At step 304, the oxidation catalyst 114 of the aftertreatment system 108 receives the exhaust gases exiting the first SCR device 110 for oxidizing ammonia present in the exhaust gases into the second quantity of NOx. Further, the oxidation catalyst 114 is in fluid communication with the first SCR device 110 and positioned downstream of the first SCR device 110 in the exhaust gas flow path "F".

Further, the one or more sensors 118, 120 of the aftertreatment system 108 determine the amount of NOx present in the exhaust gases. Additionally, the controller 134 of the aftertreatment system 108 controls the amount of the reductant being dosed in the exhaust gases. The controller 134 is in communication with the one or more sensors 118, 120 and the reductant dosing system 126.

Further, the reductant dosing system 126 doses the reductant in the exhaust gases exiting the oxidation catalyst 114. The reductant includes ammonia or urea. In an example wherein the reductant is urea, urea is dosed in the exhaust gases exiting the oxidation catalyst 114 and then the exhaust gases are passed through the hydrolysis catalyst 136 of the aftertreatment system 108. The hydrolysis catalyst 136 is disposed between the urea dosing location and the second SCR device 124.

At step 306, the second SCR device 124 of the aftertreatment system 108 receives the exhaust gases exiting the oxidation catalyst 114 for reducing the second quantity of NOx. Further, the second SCR device 124 is in fluid communication with the oxidation catalyst 114 and positioned downstream of the oxidation catalyst 114 in the exhaust gas flow path "F".

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. An aftertreatment system for treatment of exhaust gases exiting an engine, the aftertreatment system comprising:

a first Selective Catalytic Reduction (SCR) device in fluid communication with the engine and positioned downstream of the engine in an exhaust gas flow path, wherein the first SCR device includes a passive SCR device and receives the exhaust gases exiting the engine for reducing a first quantity of oxides of nitrogen (NOx) present in the exhaust gases;

an oxidation catalyst in fluid communication with the first SCR device and positioned downstream of the first SCR device in the exhaust gas flow path, wherein the oxidation catalyst receives the exhaust gases exiting the first SCR device for oxidizing ammonia present in the exhaust gases into a second quantity of NOx; and a second SCR device in fluid communication with the oxidation catalyst and positioned downstream of the oxidation catalyst in the exhaust gas flow path, wherein the second SCR device includes an active SCR device and receives the exhaust gases exiting the oxidation catalyst for reducing the second quantity of NOx.

2. The aftertreatment system of claim 1 further comprising a reductant dosing system for dosing a reductant in the exhaust gases exiting the oxidation catalyst.

3. The aftertreatment system of claim 2, wherein the reductant includes at least one of ammonia and urea.

4. The aftertreatment system of claim 3 further comprising a hydrolysis catalyst disposed between the oxidation catalyst and the second SCR device, wherein urea is dosed in the exhaust gases before the exhaust gases pass through the hydrolysis catalyst.

5. The aftertreatment system of claim 2 further comprising:

at least one sensor for determining an amount of NOx present in the exhaust gases; and a controller in communication with the at least one sensor and the reductant dosing system for controlling an amount of the reductant being dosed in the exhaust gases.

6. The aftertreatment system of claim 5, wherein the amount of the reductant dosed in the exhaust gases is varied based on the amount of NOx present in the exhaust gases.

7. The aftertreatment system of claim 5, wherein the at least one sensor includes a first sensor disposed between the oxidation catalyst and the second SCR device for determining the second quantity of NOx present in the exhaust gases exiting the oxidation catalyst.

8. The aftertreatment system of claim 5, wherein the at least one sensor includes a second sensor disposed downstream of the second SCR device in the exhaust gas flow path for determining a presence of NOx in the exhaust gases exiting the second SCR device.

9. The aftertreatment system of claim 1, wherein the engine combusts ammonia as a primary fuel during an operation thereof.

10. An engine system comprising:

an ammonia fuel tank;

an engine that combusts ammonia supplied via the ammonia fuel tank as a primary fuel during an operation thereof; and an aftertreatment system for treatment of exhaust gases exiting the engine, the aftertreatment system comprising:

a first Selective Catalytic Reduction (SCR) device in fluid communication with the engine and positioned downstream of the engine in an exhaust gas flow path, wherein the first SCR device receives the exhaust gases exiting the engine for reducing a first quantity of oxides of nitrogen (NOx) present in the exhaust gases;

an oxidation catalyst in fluid communication with the first SCR device and positioned downstream of the first SCR device in the exhaust gas flow path, wherein the oxidation catalyst receives the exhaust gases exiting the first SCR device for oxidizing ammonia present in the exhaust gases into a second quantity of NOx; and a second SCR device in fluid communication with the oxidation catalyst and positioned downstream of the oxidation catalyst in the exhaust gas flow path, wherein the second SCR device receives the exhaust gases exiting the oxidation catalyst for reducing the second quantity of NOx.

11. The engine system of claim 10 further comprising a reductant dosing system for dosing a reductant in the exhaust gases exiting the oxidation catalyst.

12. The engine system of claim 11, wherein the reductant includes at least one of ammonia and urea.

13. The engine system of claim 12 further comprising a hydrolysis catalyst disposed between the oxidation catalyst and the second SCR device, wherein urea is dosed in the exhaust gases before the exhaust gases pass through the hydrolysis catalyst.

14. The engine system of claim 11 further comprising:

at least one sensor for determining an amount of NOx present in the exhaust gases; and a controller in communication with the at least one sensor and the reductant dosing system for controlling an amount of the reductant being dosed in the exhaust gases.

15. The engine system of claim 14, wherein the at least one sensor includes a first sensor disposed between the oxidation catalyst and the second SCR device for determining the second quantity of NOx present in the exhaust gases exiting the oxidation catalyst.

16. The engine system of claim 14, wherein the at least one sensor includes a second sensor disposed downstream of the second SCR device in the exhaust gas flow path for determining a presence of NOx in the exhaust gases exiting the second SCR device.

17. A method of treating exhaust gases exiting an engine, wherein the engine combusts ammonia as a primary fuel during an operation thereof, the method comprising:

receiving, by a first Selective Catalytic Reduction (SCR) device of an aftertreatment system, the exhaust gases exiting the engine produced by combustion of ammonia in the engine, for reducing a first quantity of oxides of nitrogen (NOx) present in the exhaust gases, wherein the first SCR device is in fluid communication with the engine and positioned downstream of the engine in an exhaust gas flow path;

receiving, by an oxidation catalyst of the aftertreatment system, the exhaust gases exiting the first SCR device for oxidizing ammonia present in the exhaust gases into a second quantity of NOx, wherein the oxidation catalyst is in fluid communication with the first SCR device and positioned downstream of the first SCR device in the exhaust gas flow path; and receiving, by a second SCR device of the aftertreatment system, the exhaust gases exiting the oxidation catalyst for reducing the second quantity of NOx, wherein the second SCR device is in fluid communication with the oxidation catalyst and positioned downstream of the oxidation catalyst in the exhaust gas flow path.

18. The method of claim 17 further comprising dosing, by a reductant dosing system, a reductant in the exhaust gases exiting the oxidation catalyst, wherein the reductant includes at least one of ammonia and urea.

19. The method of claim 18 further comprising:

dosing urea in the exhaust gases exiting the oxidation catalyst; and passing the exhaust gases through a hydrolysis catalyst of the aftertreatment system, wherein the hydrolysis catalyst is disposed between a urea dosing location and the second SCR device.

20. The method of claim 18 further comprising:

determining, by at least one sensor of the aftertreatment system, an amount of NOx present in the exhaust gases; and controlling, by a controller of the aftertreatment system, an amount of the reductant being dosed in the exhaust gases, wherein the controller is in communication with the at least one sensor and the reductant dosing system.

* * * * *